US012774857B2

(12) United States Patent
Kuo et al.

(10) Patent No.: US 12,774,857 B2
(45) Date of Patent: Oct. 27, 2026

(54) THREE-DIMENSIONAL LOOP-TYPE HEAT EXCHANGING DEVICE

(71) Applicant: NIDEC CHAUN-CHOUNG TECHNOLOGY CORPORATION, New Taipei City (TW)

(72) Inventors: Hsien-Wen Kuo, New Taipei City (TW); Shih-An Yang, New Taipei City (TW); Huang-Ming Chiu, New Taipei City (TW); Yu Han, New Taipei City (TW); Cheng-Han Jheng, New Taipei City (TW)

(73) Assignee: NIDEC CHAUN-CHOUNG TECHNOLOGY CORPORATION, New Taipei City (TW)

( * ) Notice: Subject to any disclaimer, the term of this patent is extended or adjusted under 35 U.S.C. 154(b) by 148 days.

(21) Appl. No.: 18/882,609

(22) Filed: Sep. 11, 2024

(65) Prior Publication Data

US 2026/0071826 A1 Mar. 12, 2026

(51) Int. Cl.
*F28D 15/04* (2006.01)

(52) U.S. Cl.
CPC ..... *F28D 15/043* (2013.01)

(58) Field of Classification Search
CPC ..... F28D 15/0266; F28D 15/043
See application file for complete search history.

(56) References Cited

U.S. PATENT DOCUMENTS 4,516,631 A * 5/1985 Russell ..... F28D 15/0266 165/47
4,921,041 A * 5/1990 Akachi ..... F28D 15/00 165/47
11,698,229 B2 * 7/2023 Chen ..... F28F 1/12 165/104.11
11,747,089 B2 * 9/2023 Liu ..... F28D 15/0233 165/104.26
11,913,725 B2 * 2/2024 Cheng ..... F28D 15/043
2017/0356694 A1 * 12/2017 Tan ..... F28D 15/0275
2018/0292145 A1 * 10/2018 Sun ..... F28D 15/0275
2019/0049190 A1 * 2/2019 Liu ..... F28F 1/325

(Continued)

FOREIGN PATENT DOCUMENTS

TW I696801 B * 6/2020
TW 202342934 A 11/2023
TW M653956 U 4/2024

OTHER PUBLICATIONS

TWI696801B mt (Year: 2020).*

*Primary Examiner* — Gordon A Jones

(74) *Attorney, Agent, or Firm* — HDLS IPR SERVICES; Chun-Ming Shih

(57) ABSTRACT

A three-dimensional loop-type heat exchanging device includes a vapor chamber and at least one loop heat pipe. The vapor chamber has a bottom plate and a cover plate that together enclose an accommodating space. The cover plate has at least one first through-hole and a second through-hole. The loop heat pipe is disposed on the cover plate and has a curved section, a first end, and a second end. The first end is inserted in the first through-hole and has a first joint edge stacked on an inner surface of the cover plate. The second end is inserted in the second through-hole and has a second joint edge stacked on the inner surface of the cover plate. The vapor chamber has at least one first supporting structure and at least one second supporting structure, which is made of capillary material.

10 Claims, 7 Drawing Sheets

(56) References Cited

U.S. PATENT DOCUMENTS

| | | | | |
|---|---|---|---|---|
| 2019/0242654 | A1* | 8/2019 | Machida | F28D 15/043 |
| 2019/0331431 | A1* | 10/2019 | Tseng | F28F 13/08 |
| 2022/0295669 | A1* | 9/2022 | Wang | F28D 15/046 |
| 2023/0047466 | A1* | 2/2023 | Jiang | F28D 15/0266 |
| 2023/0213288 | A1* | 7/2023 | Wang | F28F 3/02 165/104.26 |
| 2025/0067519 | A1* | 2/2025 | Sahoo | F28D 15/0275 |

* cited by examiner

THREE-DIMENSIONAL LOOP-TYPE HEAT EXCHANGING DEVICE

BACKGROUND OF THE DISCLOSURE

Technical Field

The present disclosure relates to a heat exchanger, specifically to a three-dimensional loop-type heat exchanging device.

Description of Related Art

Existing three-dimensional heat sinks or heat exchangers are typically constructed by integrating a vapor chamber with multiple heat pipes. To enhance the structural stability at the junctions between the vapor chamber and the heat pipes, ends of the heat pipes are commonly perforated before being welded inside a bottom plate of the vapor chamber. This integration within the bottom plate not only increases a junction area but also utilizes the perforations to maintain a vacuum chamber within both the vapor chamber and the heat pipes, thereby facilitating efficient heat transfer through phase changes between vapor and liquid.

internally, existing three-dimensional heat sinks or heat exchangers often face challenges because the ends of the heat pipes are joined to the bottom plate of the vapor chamber. This can make it difficult for vaporized steam or working fluid to circulate back into the heat pipes, thus hindering the efficiency of creating a loop-type heat exchanging device.

In light of these shortcomings, the inventor of the present disclosure devoted significant effort to research and theoretical application, ultimately proposing this reasonably designed and effective solution to improve the aforementioned issues.

SUMMARY OF THE DISCLOSURE

The primary objective of this disclosure is to provide a three-dimensional loop-type heat exchanging device, which integrates heat pipes with a cover plate of a vapor chamber. This integration allows ends of the heat pipes to have larger through-holes for the entry of vaporized steam or working fluid, while accompanying support structures serve to support the heat pipes and restrict flow direction, thus achieving the functionality of the loop-type heat exchanging device.

To achieve the aforementioned objective, the present disclosure provides three-dimensional loop-type heat exchanging device, including a vapor chamber and at least one loop heat pipe. The vapor chamber includes a bottom plate and a cover plate, wherein the cover plate covers the bottom plate to enclose an accommodating space, and the cover plate includes at least one first through-hole and at least one second through-hole. The loop heat pipe is mounted on the cover plate, wherein the loop heat pipe includes a curved section, and a first end and a second end extending from two ends of the curved section respectively, wherein the first end is inserted in the first through-hole and provided with a first joint edge stacked to an inner surface of the cover plate, and the second end is inserted in the second through-hole and provided with a second joint edge stacked to the inner surface of the cover plate. Within the vapor chamber, at least one first supporting structure is disposed under the first joint edge, and at least one second supporting structure is disposed under the second end and blocks a port of the second end; the second supporting structure is made of capillary material.

DETAILED DESCRIPTION

In order for the Examiners to further understand the features and technical content of the present disclosure, please refer to the detailed description below and the accompanying drawings. However, the attached drawings are provided for reference and explanation only and are not intended to limit the scope of this application.

Figure 1:
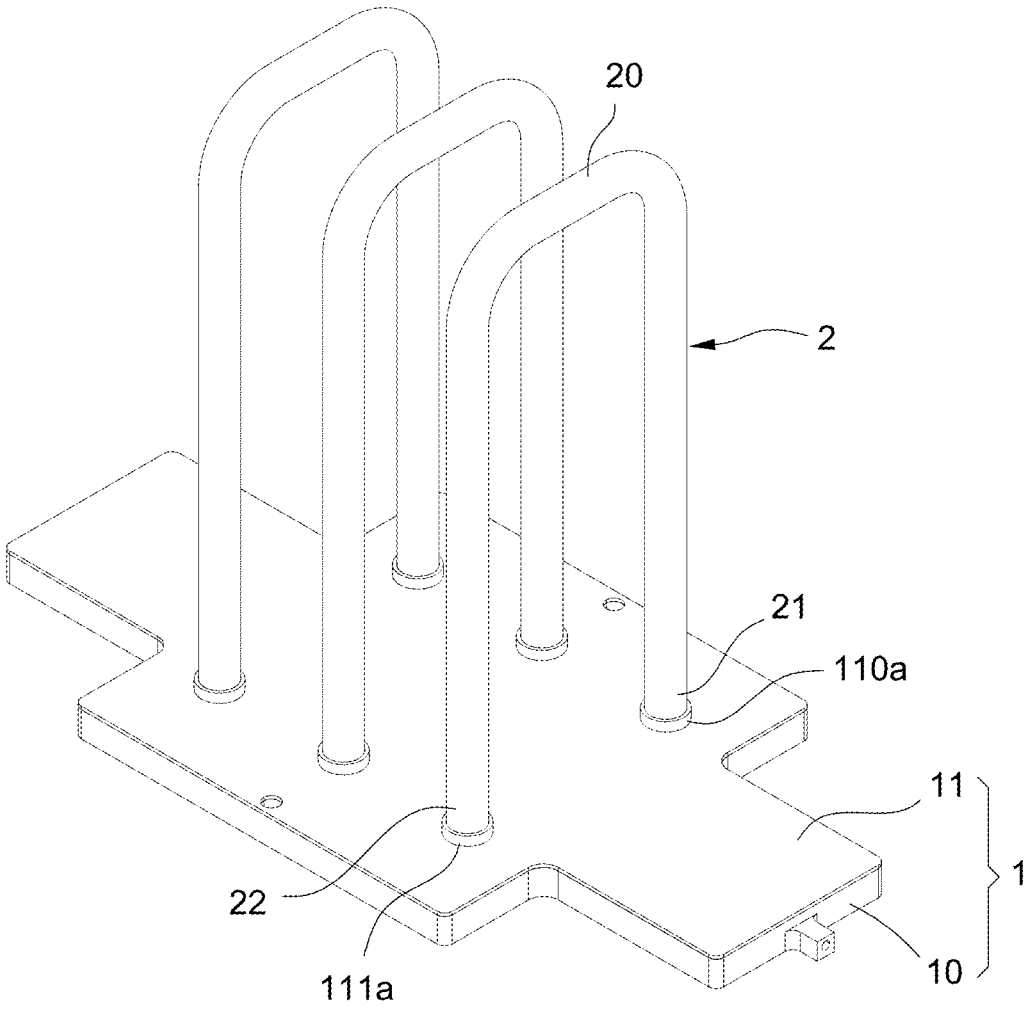
FIG. 1 is a perspective assembly view of the present disclosure.
Figure 2:
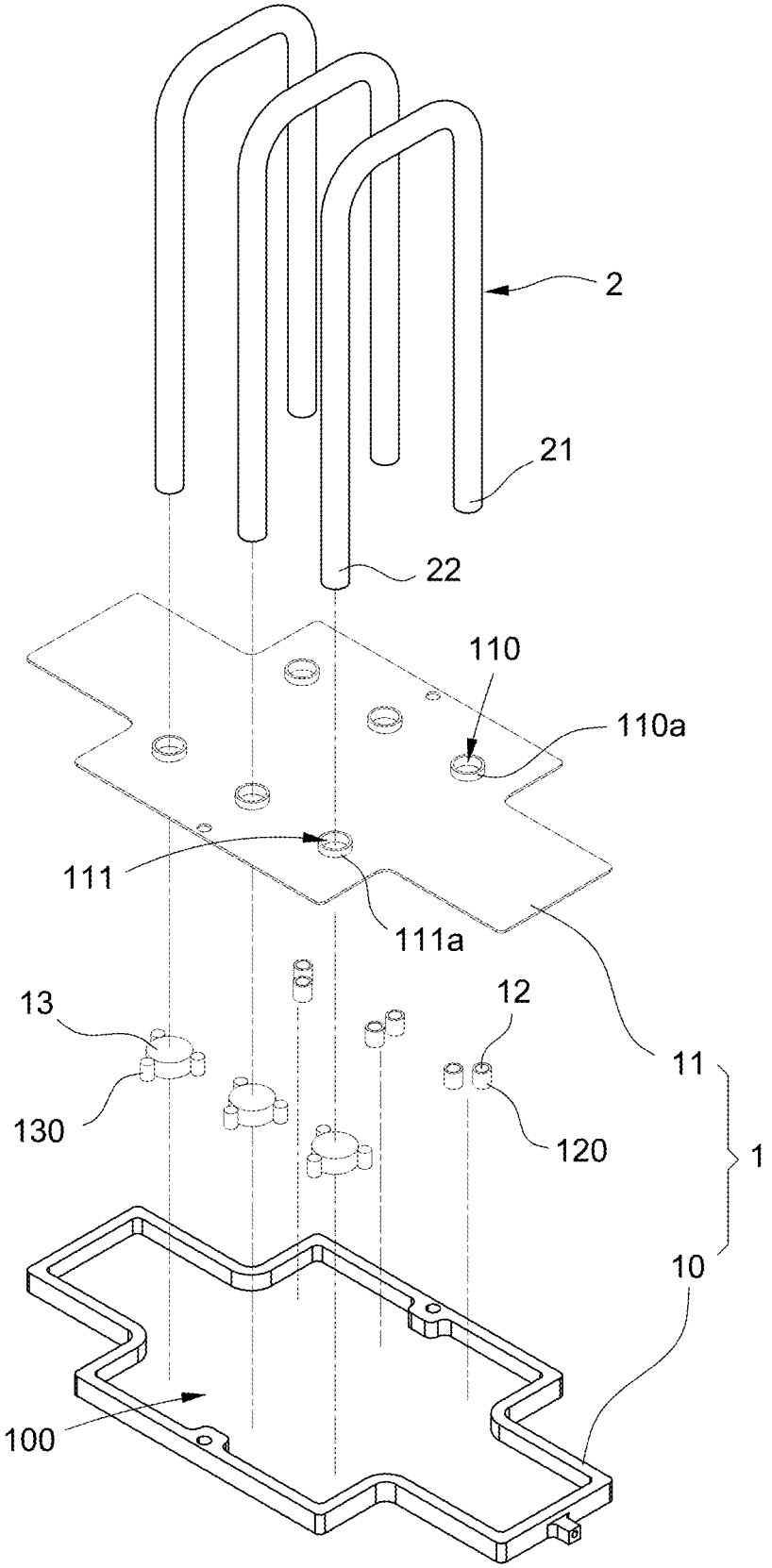
FIG. 2 is an exploded perspective view of the present disclosure.
Figure 3:
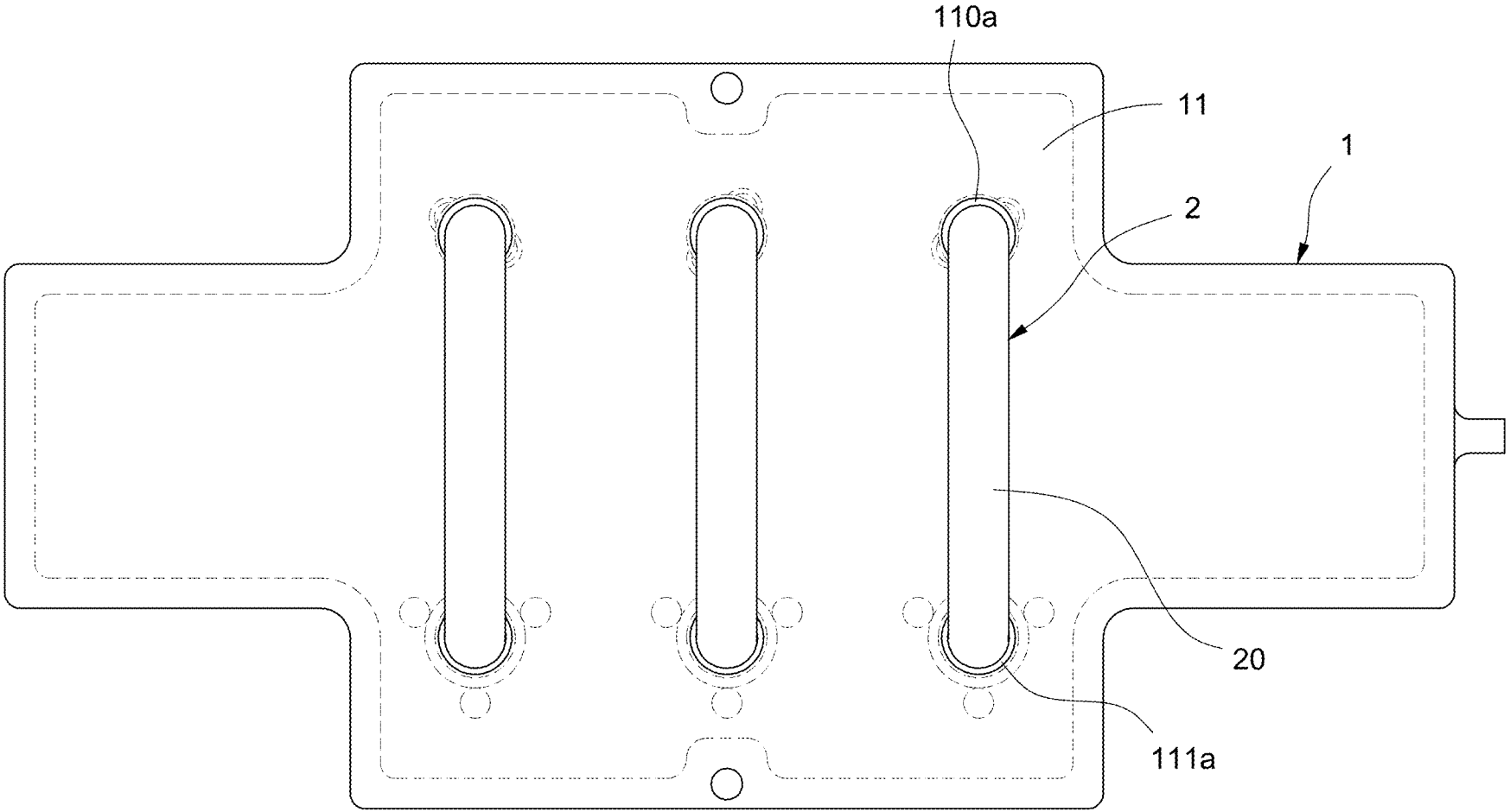
FIG. 3 is a top schematic view of the present disclosure.

Refer to FIGS. 1, 2, and 3, which are a perspective assembly view, an exploded perspective view, and a top schematic view of the present disclosure, respectively. The present disclosure provides a three-dimensional loop-type heat exchanging device, including a vapor chamber 1 and at least one loop heat pipe 2 mounted on the vapor chamber 1.

The vapor chamber 1 includes a bottom plate 10 and a cover plate 11. The cover plate 11 is mounted on the bottom plate 10 to form a sealed accommodating space 100 between the bottom plate 10 and the cover plate 11. A capillary layer 101 may be disposed in the accommodating space 100. The cover plate 11 also includes at least one first through-hole 110 and at least one second through-hole 111. A first flange 110*a* protrudes outward from the first through-hole 110, and a second flange 111*a* protrudes outward from the second through-hole 111, to facilitate connection with the aforementioned loop heat pipe 2.

The loop heat pipe 2 is designed as an inverted U-shape and is mounted on the cover plate 11 of the vapor chamber 1 mentioned above. The loop heat pipe 2 includes a curved section 20, and a first end 21 and a second end 22 extending from two ends of the curved section 20, respectively. Inside the loop heat pipe 2, capillary structures such as sintered powder, woven mesh, or grooves are disposed (not illustrated in figures). The first end 21 is inserted to the first through-hole 110 of the cover plate 11, and the second end 22 is inserted to the second through-hole 111 of the cover plate 11, allowing the curved section 20 to protrude from the cover plate 11 of the vapor chamber 1.

Figure 4:
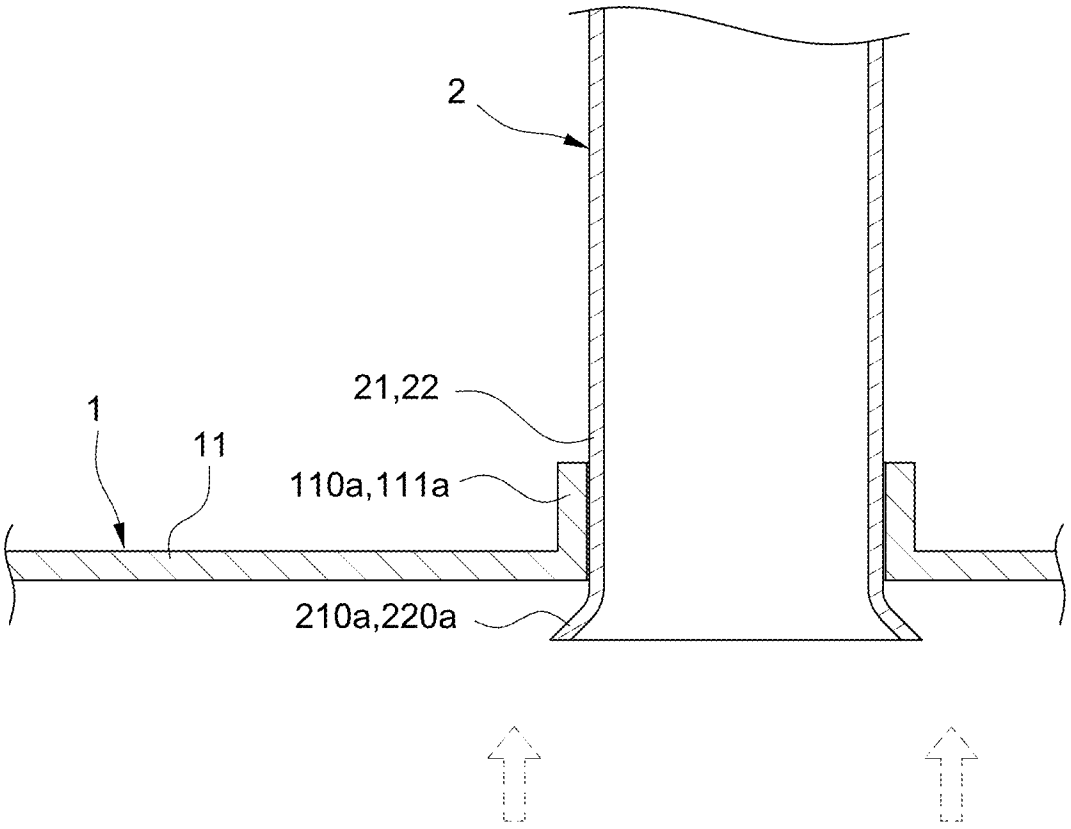
FIG. 4 is a schematic view (1) illustrating process steps for a loop heat pipe and a cover plate of the present disclosure.

As illustrated in FIG. 4, when the first end 21 and the second end 22 of the loop heat pipe 2 are inserted into the first through-hole 110 and the second through-hole 111 of the cover plate 11, respectively, a first expanded end port 210*a* is formed at a port of the first end 21, and a second expanded end port 220*a* is formed at a port of the second end 22. Both expanded end ports 210*a* and 220*a* may be bell-shaped, and through processes such as stamping or pressing, pressure is applied towards an inner surface of the cover plate 11 on both the first expanded end port 210*a* and the second expanded end port 220*a* (as indicated by arrows in FIG. 4). This process flattens the first expanded end port 210*a* into a first joint edge 210 and the second expanded end port 220*a* into a second joint edge 220, each being stacked on the inner surface of the cover plate 11.

Figure 5:
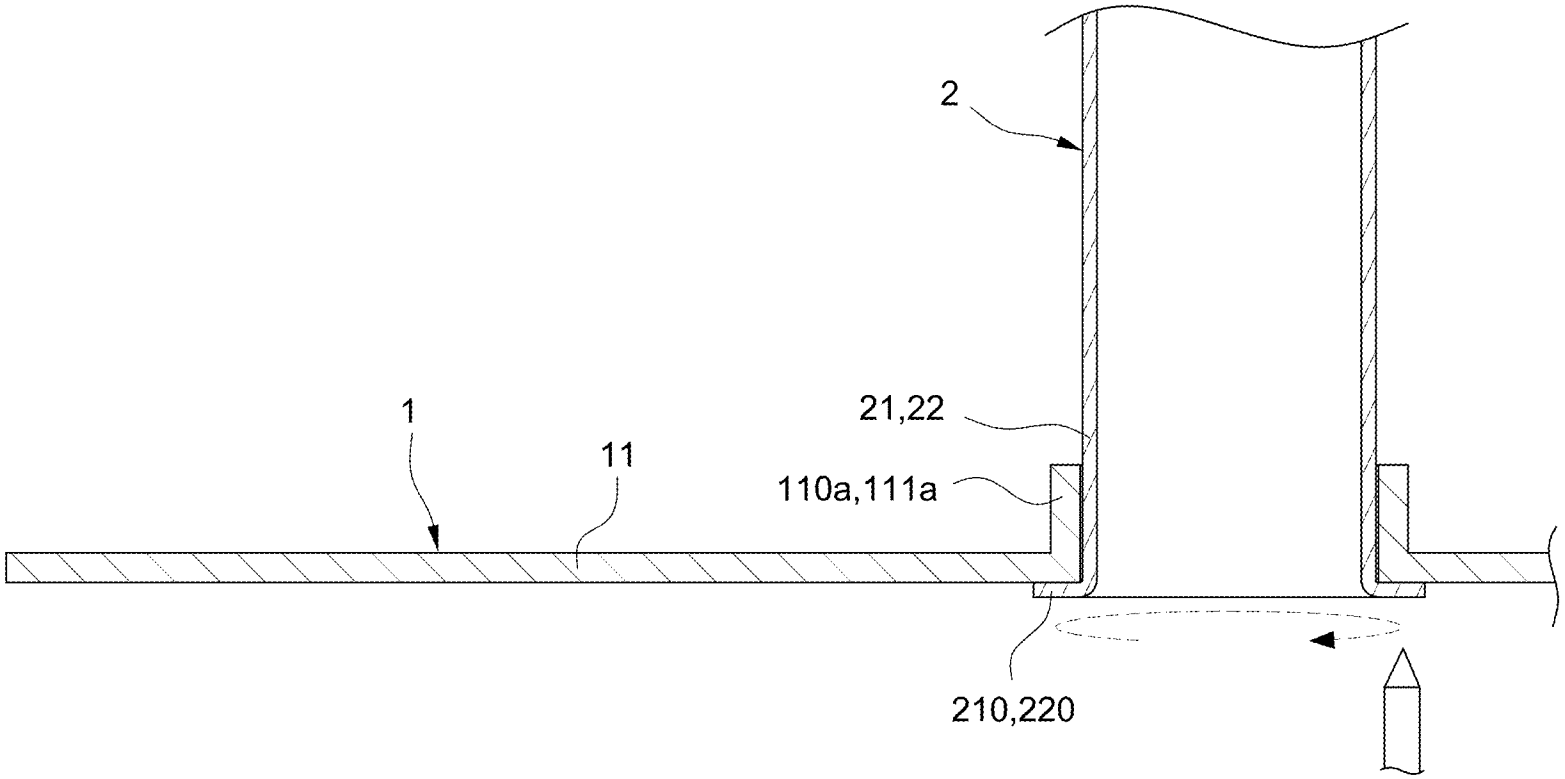
FIG. 5 is a schematic view (2) illustrating the process steps for the loop heat pipe and the cover plate of the present disclosure.

Further, as shown in FIG. 5, the first joint edge 210 and the second joint edge 220 may be welded to the inner surface of the cover plate 11 by using a filler-free welding method such as laser welding or diffusion welding. The filler-free welding process allows the first joint edge 210 and the second joint edge 220 to be connected to the inner surface of the cover plate 11 through laser or diffusion welding, thereby securing the loop heat pipe 2 at the first through-hole 110 and the second through-hole 111 without leaving any weld marks on the exterior of the cover plate 11, which may affect the appearance. Additionally, a gap between the first end 21 of the loop heat pipe 2 and the first flange 110*a*, or a gap between the second end 22 and the second flange 111*a*, may be further sealed using filler welding techniques.

Figure 6:
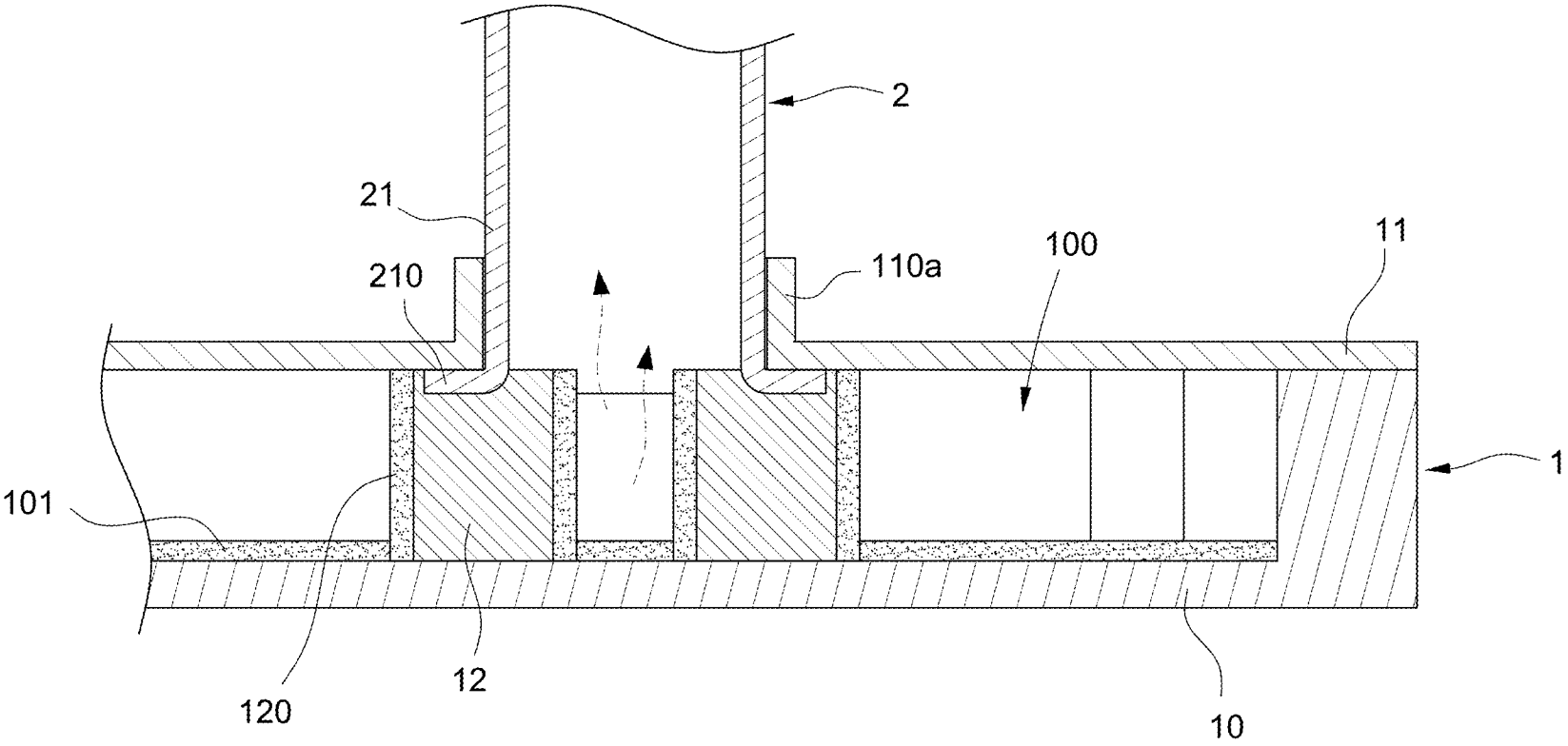
FIG. 6 is a partially cross-sectional schematic view of a first supporting structure of the present disclosure.
Figure 7:
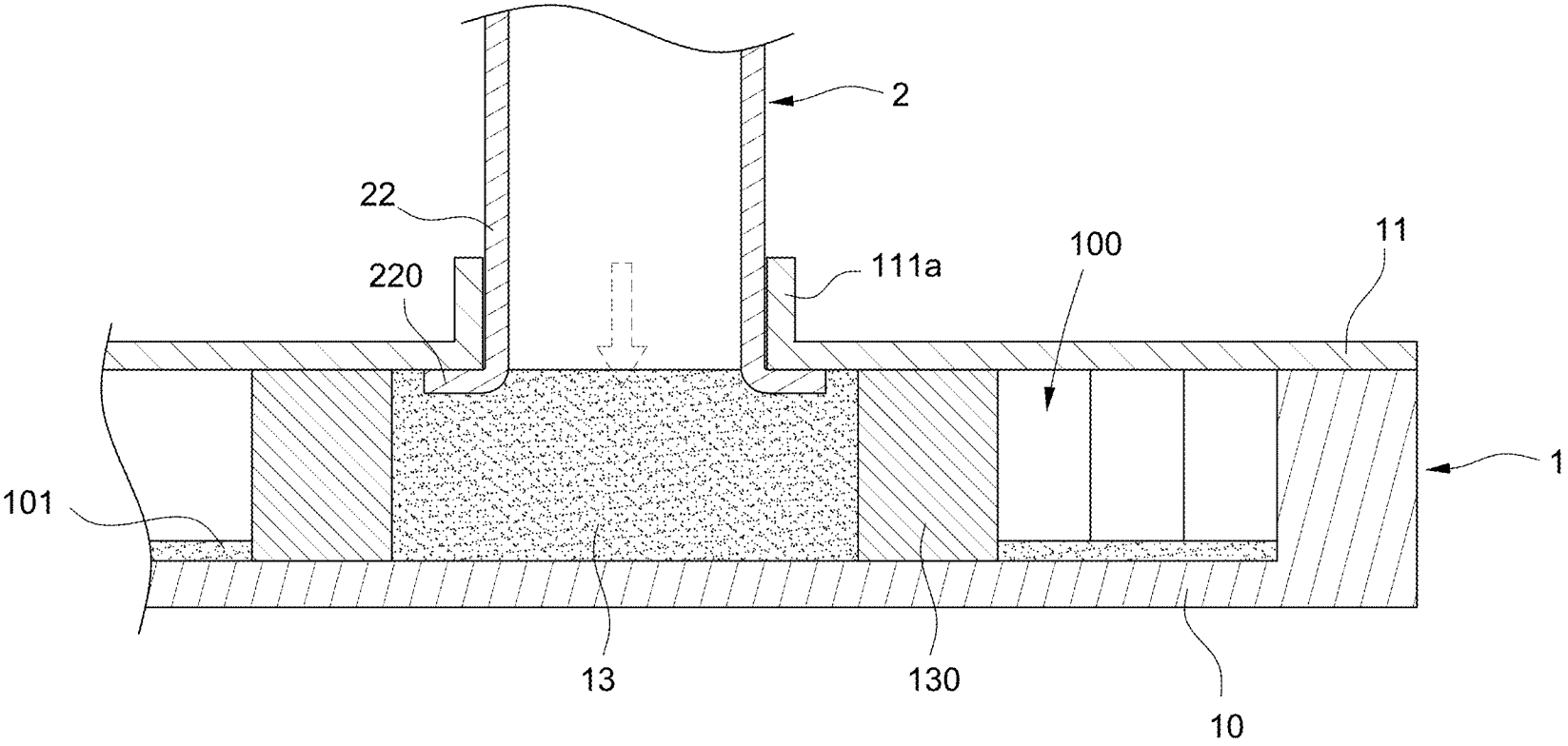
FIG. 7 is a partially cross-sectional schematic view of a second supporting structure of the present disclosure.

Further refer to FIGS. 1 and 2, within the aforementioned vapor chamber 1, there are at least one first supporting structure 12 located under the first joint edge 210, and at least one second supporting structure 13 located under the second joint edge 220 and blocking the port of the second end 22. At least the second supporting structure 13 is made of capillary material. As shown in FIG. 6, there may be multiple first supporting structures 12 disposed around and under the first joint edge 210, allowing an opening of the first end 21 to communicate with the accommodating space 100. This setup enables a vapor-state working fluid inside the vapor chamber 1 to enter the loop heat pipe 2 through the first end 21, condense back into a liquid-state working fluid in the curved section 20, and then flow into the accommodating space 100 through the capillary action generated by the second supporting structure 13, as shown in FIG. 7. The second supporting structure 13 blocks below the port of the second end 22, providing resistance to the vapor-state working fluid inside the accommodating space 100, directing the vapor-state working fluid towards the first end 21. The second supporting structure 13 directs the condensed liquid to flow back into the accommodating space 100. Furthermore, as illustrated in FIGS. 2, 6, and 7, the exterior of the first supporting structure 12 is covered with a capillary ring 120, while the second supporting structure 13 is surrounded by a plurality of support pillars 130. The support pillars 130 are solid structures.

Thus, through the described structural composition, this application achieves the three-dimensional loop-type heat exchanging device.

Therefore, with this three-dimensional loop-type heat exchanging device, not only can the working fluid within the vapor chamber 1 and the loop heat pipe 2 flow in a specified direction to form a loop-type heat exchange mechanism, but it also allows the loop heat pipe 2 to be securely mounted on the vapor chamber 1.

However, the above description is merely a preferable practical embodiment of the present disclosure and does not limit the protection scope for the present disclosure. Therefore, all equivalent technical solutions and means, which use the described principles depicted in the specification and drawings, are considered to be within the scope of the present disclosure, as clarified herein.

What is claimed is:

1. A three-dimensional loop-type heat exchanging device, comprising:

a vapor chamber, comprising a bottom plate and a cover plate, wherein the cover plate covers the bottom plate to enclose an accommodating space, and the cover plate comprises at least one first through-hole and at least one second through-hole;

at least one loop heat pipe, mounted on the cover plate, wherein the loop heat pipe comprises a curved section, and a first end and a second end extending from two ends of the curved section respectively, the first end is inserted in the first through-hole and comprises a first joint edge bent outward to be directly contacted and stacked on an inner surface of the cover plate, and the second end is inserted in the second through-hole and comprises a second joint edge bent outward to be directly contacted and stacked on the inner surface of the cover plate; and at least one first supporting structure disposed inside the vapor chamber and under the first end and at least one second supporting structure disposed inside the vapor chamber and under the second end, wherein the first supporting structure is hollow and abuts the first joint edge, and the second supporting structure made of a capillary material abuts the second joint edge and blocks an entire port of the second end, providing resistance to vapor-state working fluid inside the accommodating space and directing the vapor-state working fluid back towards the first end.

2. The three-dimensional loop-type heat exchanging device according to claim 1, wherein the loop heat pipe is bent into an inverted U-shape.

3. The three-dimensional loop-type heat exchanging device according to claim 1, wherein the first joint edge and the second joint edge are connected to the inner surface of the cover plate through a filler-free welding.

4. The three-dimensional loop-type heat exchanging device according to claim 3, wherein the filler-free welding is a laser welding or a diffusion welding.

5. The three-dimensional loop-type heat exchanging device according to claim 1, wherein the cover plate includes a first flange protruding outward from the first through-hole, and a second flange protruding outward from the second through-hole.

6. The three-dimensional loop-type heat exchanging device according to claim 5, wherein a gap between the first end and the first flange, or a gap between the second end and the second flange, is sealed through a filler welding.

7. The three-dimensional loop-type heat exchanging device according to claim 1, wherein multiple first supporting structures are disposed around and under the first joint edge.

8. The three-dimensional loop-type heat exchanging device according to claim 1, wherein an exterior of the first supporting structure is covered with a capillary ring.

9. The three-dimensional loop-type heat exchanging device according to claim 1, wherein the second supporting structure is surrounded by multiple support pillars.

10. The three-dimensional loop-type heat exchanging device according to claim 9, wherein the support pillars are solid structures.

* * * * *